United States Patent [19]

Schenk et al.

[11] Patent Number: 4,719,963

[45] Date of Patent: Jan. 19, 1988

[54] PROCESS FOR THE PRODUCTION OF A METAL STRAND, MORE PARTICULARLY IN THE FORM OF A STRIP OR SECTION, BY CASTING AND APPARATUS FOR THE PERFORMANCE OF THE PROCESS

[75] Inventors: Horst Schenk, Dortmund; Peter Dziura, Iserlohn, both of Fed. Rep. of Germany

[73] Assignee: Sundwiger Eisenhutte Maschinenfabrik Grah & Co., Hemer-Sundwig, Fed. Rep. of Germany

[21] Appl. No.: 873,557

[22] Filed: Jun. 12, 1986

[30] Foreign Application Priority Data

Jun. 19, 1985 [DE] Fed. Rep. of Germany ..... 3521778
Jan. 29, 1986 [DE] Fed. Rep. of Germany ..... 3602594

[51] Int. Cl.[4] ..... B22D 11/06

[52] U.S. Cl. ..... 164/461; 164/463; 164/474; 164/475; 164/479

[58] Field of Search ..... 164/463, 423, 479, 429, 164/461, 474, 475

[56] References Cited

U.S. PATENT DOCUMENTS

| | | | |
|---|---|---|---|
| 2,171,132 | 8/1939 | Simons | 164/423 X |
| 4,285,386 | 8/1981 | Narasimhan | 164/463 |
| 4,290,476 | 9/1981 | Smith et al. | 164/463 X |
| 4,386,648 | 6/1983 | Hilzinger et al. | 164/423 X |
| 4,479,528 | 10/1984 | Maringer | 164/423 |
| 4,485,839 | 12/1984 | Ward | 164/463 |

FOREIGN PATENT DOCUMENTS

| | | | |
|---|---|---|---|
| 126267 | 11/1984 | European Pat. Off. | 164/463 |
| 58-16761 | 1/1983 | Japan | 164/463 |
| 60-174239 | 9/1985 | Japan | 164/463 |

*Primary Examiner*—Kuang Y. Lin
*Attorney, Agent, or Firm*—Sprung Horn Kramer & Woods

[57] ABSTRACT

The invention relates to a process and apparatus for the casting of metal strands, more particularly in the form of strips. The molten metal emerging from a slotted die 2 is applied to the cooling surface of a cooling member 1 which is moved past the slotted die 2. Allowing for the law of solidification, at the start of casting the strip outlet side die lip is gradually increased from a minimum distance from the cooling surface to the required final distance in such a way that the free gap between the wedge-shaped developing solidification front of the cast strip 7 and the die lip 5 remains small enough to prevent the molten metal from flowing out through the gap in an uncontrolled manner. The end face edge of the slotted die 2 can be borne via one or more gas cushions on the cooling surface and the free surface of the cast strand.

21 Claims, 33 Drawing Figures

Figure 1:
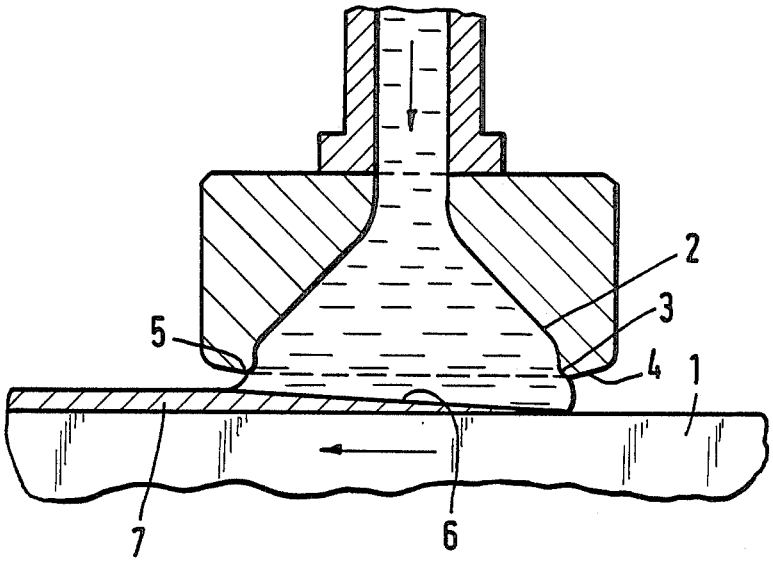

PROCESS FOR THE PRODUCTION OF A METAL STRAND, MORE PARTICULARLY IN THE FORM OF A STRIP OR SECTION, BY CASTING AND APPARATUS FOR THE PERFORMANCE OF THE PROCESS

The invention relates to a process for the production of a metal strand, more particularly in the form of a strip or section, wherein molten metal is applied from a die, constructed more particularly in the form of a slotted die, onto the cooling surface of a cooling member moved past the die with a narrow gap.

In a known casting process of the kind specified (EP No. 0 026 812 81) a wedge-shaped solidification front is formed in the zone of the slotted nozzle end face disposed at a close distance from and parallel with the cooling surface. To prevent molten metal from flowing out in an uncontrolled manner during casting, the free gap between the die lips and the cooling surface of the cooling member is kept so small that solidification is practically completed at the cooling surface inlet side die lip and the viscosity of the molten metal is adequate to prevent it from flowing out freely through the gap. That method is unsuitable for casting relatively thick strips (above 0.1 mm), since there is the risk that molten metal may emerge more particularly between the cooling surface inlet side die lip, where the molten metal encounters the largest free cross-section, and the cooling surface.

A further difficulty in producing strips by casting is that the strips cannot be produced with narrow thickness tolerances. If casting is performed from a slotted die which is so narrow in the direction of movement of the cooling surface that the majority of strip solidification on the moving cooling surface takes place outside the slotted die, narrow thickness tolerances can hardly be maintained, since pressure and temperature fluctuations take place at the die slot during the casting process. Fluctuations in strip thickness can be only partially corrected with delay by adaptation of the cooling surface speed and/or adjustment of the distance between the strip outlet side die lip and the cooling surface. Deviations from the required thickness which are practically uncorrectable take place at the strip edges, since the molten metal can flow away laterally outside the slotted die. For this reason such strips must regularly be rerolled. However, rerolling alters the structure of the strip, and this is undesirable for many applications. (EP No. 0 040 069 A1 and EP No. 0 040 073 A1).

Another problem of strip casting is that beads of condensate and gas adhering to the moving cooling surface are dragged from the inlet side die lip under the molten metal applied to the cooling surface, expand due to the heating occurring at that place and as a result spoil the smoothness of the strip surface. To improve smoothness, it is known to heat the cooling surface upstream of the die and to remove beads of condensate and gas therefrom by suction (German No. OS 29 50 406).

It is an object of the invention to provide a process and an apparatus for the production of a metal strand, more particularly a metal strip, which make possible the production of strands within narrow tolerances and strips with thicknesses up to at least 1.6 mm within narrow thickness tolerances and with practically any strip width.

To this end in the process according to the invention allowing for the solidification front building up in wedge shape in the zone of the die at the start of casting onto the moving cooling surface of the cooling member, and with adaptation of the speed of the cooling surface, the free gap between the strand outlet side die lip and if necessary the lateral die lips is increased gradually from a small initial value, preventing the molten metal from flowing out uncontrolled, to the final value which corresponds to the required strand thickness and also prevents the metal from flowing out uncontrolled.

In a partly alternative process the problem is solved by the feature that allowing for the solidification front building up in wedge shape in the zone of the die lip during the start of casting onto the upwardly moving cooling surface part of the cooling member the level of the molten bath between the cooling surface of the cooling member and the lip disposed laterally alongside the cooling member is gradually raised up to the outlet side die lip determining strand thickness, in such a way that when the surface of the molten bath reaches the outlet side die lip, the free gap between the consolidation front and the outlet side die lip is small enough to prevent the molten metal from flowing out uncontrolled.

In both processes the distance between the outlet side die lip and the cooling member is increased and the level of the bath is gradually raised, in dependence on the solidification front. Allowance is made for different influencing magnitudes, such as the required strand thickness, the die width (inside distance of the two die lips) and the speed of the cooling surface. These various influencing factors are connected with one another in the law of solidification $$d=A\cdot w/v$$

where d=strand thickness, w=die width in the direction of movement of the cooling surface, v=speed of the cooling surface and A=a proportionality factor between 0.1 and 0.8.

The fact that according to the invention the law of solidification is taken into account from the start of casting ensures that no molten metal flows out uncontrolled or accidentially from the zone of the die and the cooling surface. The feature that even after the start of casting the speed of the cooling surface of the cooling member is so adjusted that the solidification front remains inside the die also ensures that the strand or strip has narrow tolerances such as cannot be achieved by know processes.

The process according to the invention also enables multi-layer strips, preferably solidifying in crystalline form, to be produced from various metals or metal alloys, whose layers are particularly intimately interconnected. Bimetallic strips, but also plated strips—i.e., strips with thin covering layers—can be mentioned as examples of such strips. To produce such strips by the process according to the invention, molten metal is applied to the surface of the cast metal strip remote from the cooling surface from another die disposed immediately upstream of the one die, in the same manner as from the one die. The molten metal from the other die is applied to the metal strip from the one die whose surface is still molten. In this manner even strips with more than two layers can be produced.

In order to prevent faults at the boundary between the layers in the production of such multi-layer strips, according to the invention the surface of the one metal strip remote from the cooling surface is protected against oxidizing influences until the further molten metal is applied.

The process according to the invention also enables a strip consisting of a number of component strips to be produced. In an embodiment of the invention aimed at this objective, molten metal from one or more further dies is applied to the moving cooling surface immediately alongside the molten metal from the one die, in the same manner as from the last-mentioned die, the metals emerging from the the dies or plurality of dies being brough together in their molten phase in the area of their boundary zones.

However, not only multi-layer strips of different metals or alloys can be produced by the process according to the invention, but also particularly thick metal strips of the same metal. More particularly very thick amorphous metal strip can be produced. To this end when a number of layers are cast one above the other, after each casting the strip passes through a cooling distance before the next layer is cast on. In this embodiment it is important for the individual layers not to be too thick, since otherwise despite the cooling distances provided, the rapid cooling required for amorphous solidification cannot take place. In this way via the number of layers a relatively thick strip of mainly amorphous structure can be produced.

When a number of layers are cast one above the other, according to the invention in the zone of each cooling distance, the surface of the particular layer remote from the cooling surface is kept under a protective gas atmosphere, or such zone is at least partially evacuated, so that no troublesome boundaries can form between the individual layers.

A convenient length for the cooling distance is 0.8–16 times the width of the preceding die in the direction of movement of the cooling surface of the cooling member.

For the production of particularly thick metal strips, an embodiment of the process according to the invention is suitable which is characterized in that with the omission of the outlet side die lip, the molten metal is cast between the moving cooling surfaces of two cooling members which can be adjusted at a mutual distance in accordance with the developing solidification fronts, the function of the missing die lip being performed for the molten metal cast on each cooling surface by the solidification front of the other strand. In this embodiment of the invention also the distance of the two cooling surfaces and their speed can be adjusted to ensure that no molten metal flows out uncontrolled. The required strand thickness is obtained by increasing the distance while adapting the speed. In this case also the strip leaves the zone of the cooling members with narrow tolerances. In this embodiment of the process the two layers of the strand are particularly intimately interconnected, since they are created from one bath of molten metal. However, this process can also be used to produce strands from different metals. In that case all that needs to be done is to feed the gap between the two cooling surfaces from different slotted dies.

The invention also relates to an apparatus for the performance of the process for the casting of metal strands in the form of strips and sections, comprising a die, constructed more particularly in the form of a slotted die, which is connected to a storage tank for molten metal, and a cooling member onto whose cooling surface, disposed with a narrow gap disposed upstream of and more particularly at an inclination to the end side of the die and movably in relation thereto, the molten metal can be applied. Such an apparatus is characterized according to the invention in that the distance of the outlet side die lip from the cooling surface of the cooling member can be adjusted. Preferably adjustability is achieved by the feature that the die can be pivoted around an axis extending parallel with the cooling surface of the cooling member and transversely of its direction of movement. In this embodiment the cooling surface can be disposed both horizontally and also inclined at an angle to the horizontal.

However, according to an alternative feature in the zone of the die the cooling surface of the cooling member is disposed at an inclination to the horizontal, and the width of the die (inside distance) of the cooling surface inlet and strand outlet side die lip is disposed at a distance corresponding to the length of the wedge-shaped solidification front of the strand to be cast. In this embodiment the gradual raising of the level of the molten metal ensures that molten metal does not flow out uncontrolled.

The invention also relates to a variant apparatus comprising a die, constructed in the form of a slotted die, to which molten metal can be supplied from a storage tank, and a movable cooling member onto whose cooling surface molten metal can be applied. In this apparatus alongside the one cooling member a second cooling member is disposed whose distance can be varied and whose cooling surface, movable in the same sense, cooperates with the cooling surface of the one cooling member to form the slotted die (casting gap) to which the molten metal can be supplied from below. Preferably the cooling members are constructed in the form of rollers.

With such an apparatus both strands, more particularly strips of metal identical over the cross-section can be produced, and also two-layer strips from different metals. In the latter case all that is needed is to dispose between the cooling surfaces a partition which cooperates with the two cooling surfaces to form two inlets for different molten metals.

More particularly when applying molten metal to an upwardly moving cooling surface or when conveying molten metal upwards into the gap formed by the cooling members, advantageously the lateral die lips are provided with projecting attachments which can temporarily limit the width and, if they are drawn sufficiently far forwards, act as protection against splashes during the gradual raising of the level of the molten metal between the cooling surfaces of the or each cooling member and the die.

To protect the strand outlet side die lip, which must be adjusted at a predetermined distance for a predetermined strand thickness, in accordance with the law of solidification, against overloading if the cooling surface speed is inaccurately adjusted, the lip can be adjustable and mounted to yield under excess pressure.

To produce strands, more particularly in the form of strips, built up from individual layers, according to another possible feature of the invention two or more dies are disposed close behind or beside one another in the direction of movement of the cooling surface.

For the production of relatively thick strands (strips) of amorphous structure built up from layers, two or more die slots can be disposed in one die at a distance one behind the other in the direction of movement of the cooling surface. The distance between two adjacent die slots should be 0.8 to 16 times the width of the preceding die slot. It should be possible to partially evacuate or act with a protective gas upon the gaps between the parallel die slots above the strand.

The process according to the invention enables not only flat strips to be produced, but also profiled strips or profiled strands. An apparatus devized for this purpose is characterized in that the strand outlet side die lip is so profiled that it forms a gap of width varying over strand width in relation to the cooling surface of the cooling member, and the cooling surface inlet side die lip is so offset in accordance with the section of the strand outlet side die lip in the direction of the cooling surface of the cooling member that in the zone of a large gap the cooling surface inlet side die lip is at a larger width (distance) in the direction of movement of the cooling surface from the strand outlet side die lip than in the zone of a small gap. This embodiment of the invention ensures that, in accordance with the profile of the article manufactured, a solidification front spreads out which enables casting to be started without the molten metal running out uncontrolled and the profile to be produced within narrow limits.

To produce profiled strands or strips, a profile can also be let into the cooling surface of the cooling member.

To enable more particularly the first two alternative apparatuses according to the invention to cast metal strands, more particularly strips, of a minimum thickness of 1 mm, but also to enable apparatus of the same category to produce other thickness tolerances, if at all possible accompanied by an improvement of surface structure, according to the invention the slotted die can be borne by its end face edge via one or more gas cushions on the cooling surface and the free surface of the cast metal strip.

Due to the end face of the slotted die being borne by means of gas cushions, very narrow gaps can be adjusted both on the cooling surface and also on the cast metal strip, without the risk of the die lips contacting the cooling surface or strip. Moreover, the air cushions act as a barrier against the molten metal. As a result of the very narrow distances, the narrow tolerances can be maintained not only with thin strips, but also with thicker strips over 1 mm in thickness, for example. Due to the possible narrow distances between the die lips and the cooling surface and the surface of the cast metal strip, and the additional seal provided by the air cushions, operations can be performed at a higher casting pressure, and this also has a favourable effect on the maintenance of narrow tolerances and the smoothness of the strip.

Preferably the gas pressure in the gas cushions can be adjusted. Such adjustment will be use when controlling strip thickness tolerances by adaptation of the cooling surface speed, to prevent molten metal from emerging through the gap, altered by control within narrow limits, between the die lips and the cooling surface and the surface of the cast metal strip.

To reduce the extent to which the smoothness of the strip is spoilt by beads of gas dragged in from the cooling surface inlet side gas cushion, the gas supplied to the gas cushion can be heated. In that case, due to the still higher temperature of the molten metal, the beads of gas dragged in can no longer expand so much. However, since the pressure build-up of the gas cushion involves a heavy gas loss, the heating of the gas supplied would be very costly in energy. For this reason a construction is preferred wherein provided between the or each gas cushion and at least the cooling surface inlet side die lip is a chamber which can be partially evacuated or via which heated gas can be supplied. With partial evacuation the gas flowing out of the upstream gas cushion is substantially removed, thus reducing the quantity of beads of gas otherwise dragged in. If heated gas is supplied, such gas acts as it were as a barrier for the gas of the upstream gas cushion. Moreover, the dragged-in heated beads of gas subsequently expand only to a small extent in comparison with dragged-in cold beads of condensate or gas. Preferably protective gas is supplied to the gas cushions and the chamber, to prevent any oxidation of the metal on the side adjacent the cooling surface.

It is advisable to provide a chamber for partial evacuation or protective gas not only at the cooling surface inlet side die lip, but also at the lateral die lips and at the strip outlet side die lip. This is advisable more particularly if no protective gas is supplied to the gas cushion. In that case oxidation can be at least reduced by partial evacuation or by the protective gas supplied.

There are various possible ways of building up the gas cushion. For example, a chamber open in the direction of the cooling surface and the free strip surface can be provided via which the supplied gas is distributed, so that the gas cushion can form in front of such chamber.

Preferably, however, the or each gas cushion contain a porous body via which the gas required for building up pressure can be supplied. It can be retained with provision for movement in a guide in the slotted die body, to be able to adapt itself to the position of the free strip surface if fluctuations occur in strip thickness.

In order on the one hand to be able to influence the thickness profile by changing the position of the die lips in relation to the cooling surface and the strip, and on the other to ensure reliable support while maintaining narrow tolerances, according to another feature of the invention the position of the associated chambers can be adjusted, if necessary together with the porous members, individually in relation to the slotted die body.

Figure 2:
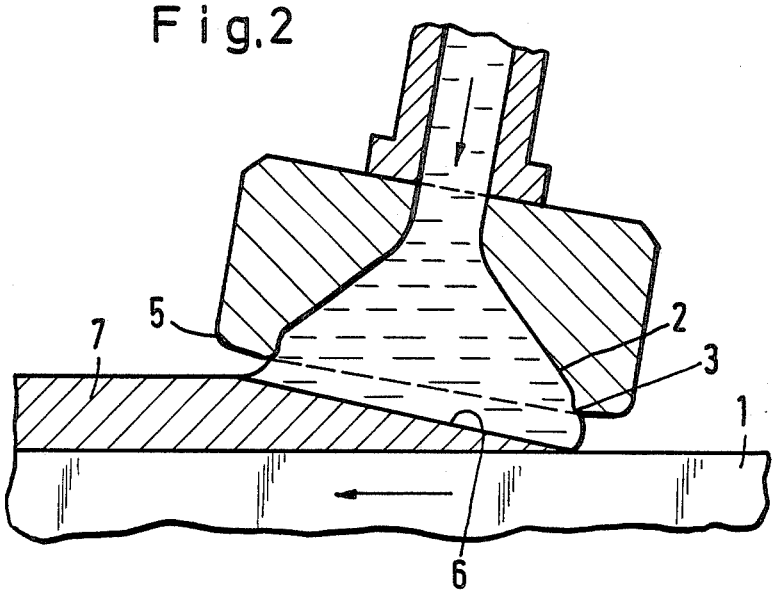
Figure 3:
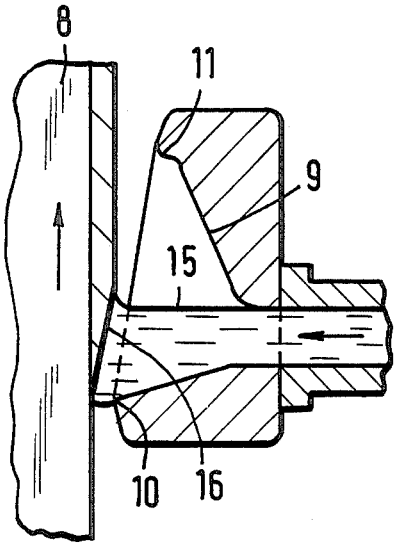
Figure 5:
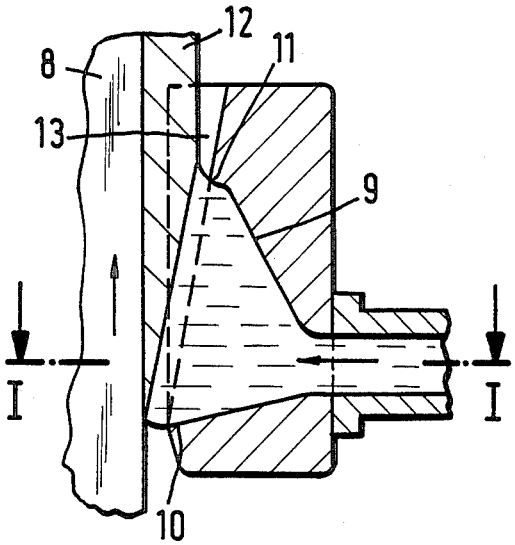
Figure 4:
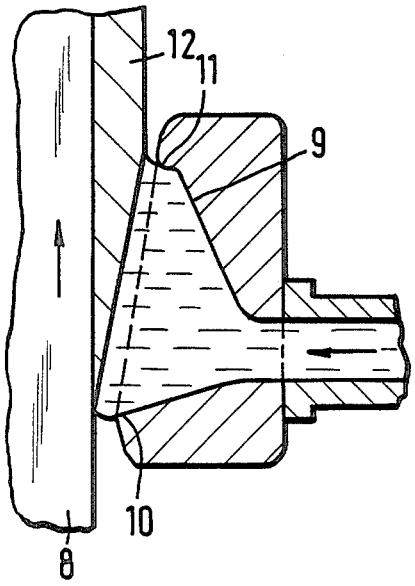
Figure 6:
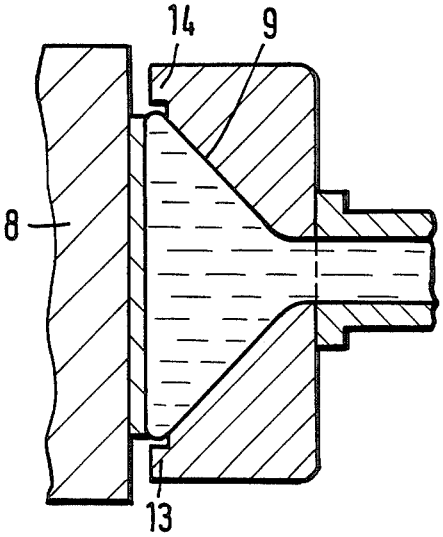
Figure 7:
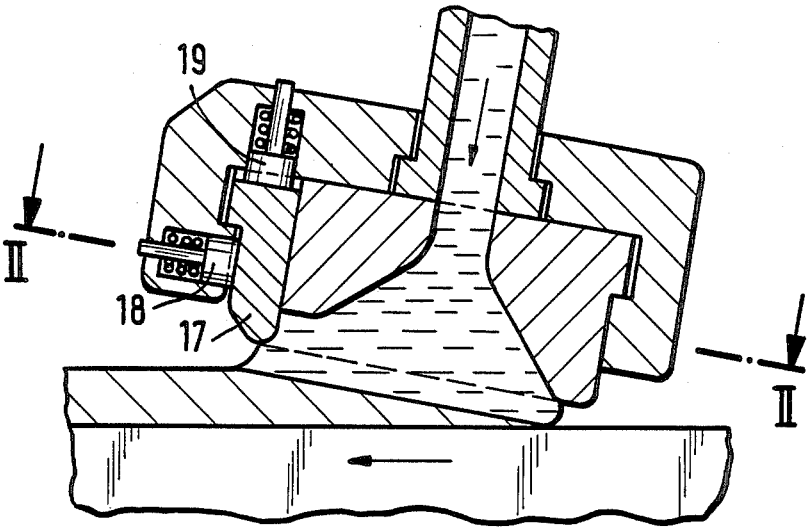

The drawings show:

FIG. 1 a pivotable slotted die above a horizontal movable cooling surface of a cooling member, in cross-section in the direction of movement of the cooling surface during the start of casting, FIG. 2 the slotted die shown in FIG. 1 after the start of casting, FIG. 3 a non-pivotable slotted die, directed laterally against a vertically disposed movable cooling surface of a cooling member, in cross-section in the direction of movement of the cooling surface during the start of casting, FIG. 4 the slotted die shown in FIG. 3 after the start of casting, FIG. 5 the slotted nozzle shown in FIG. 4 with lateral attachments, FIG. 6 the slotted nozzle shown in FIG. 5, sectioned along the line I—I in FIG. 5, FIG. 7 a pivotable slotted die above a horizontally disposed movable cooling surface of a cooling member, in cross-section in the direction of movement of the cooling surface, with an outlet side die lip yielding under pressure.

Figure 8:
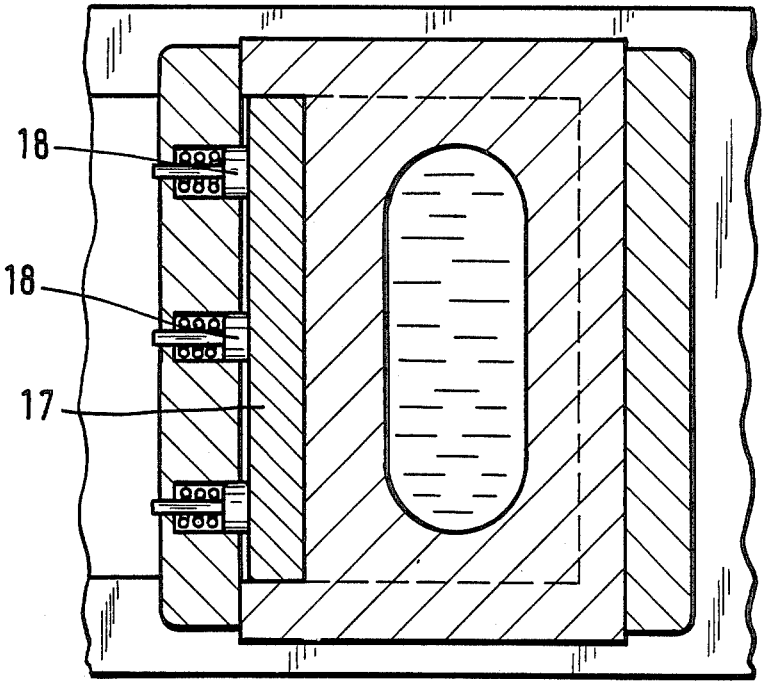
Figure 9:
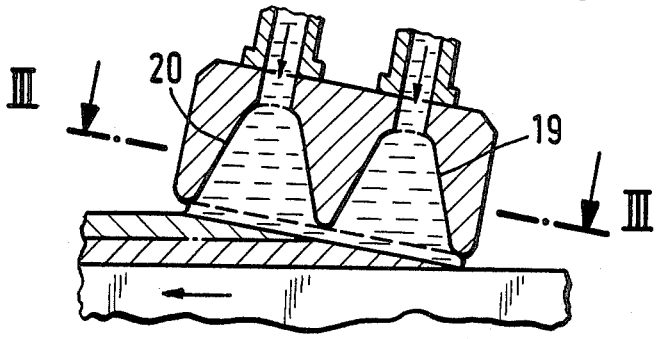
Figure 10:
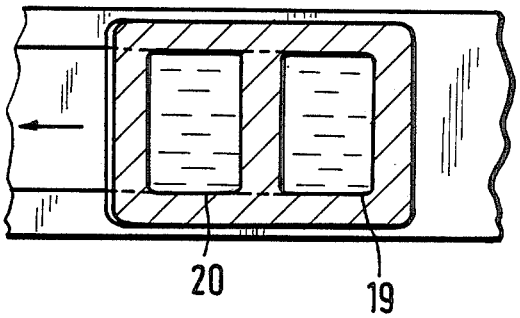
Figure 11:
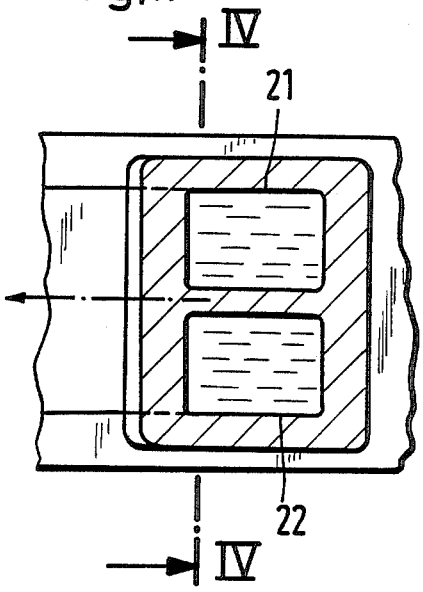
Figure 12:
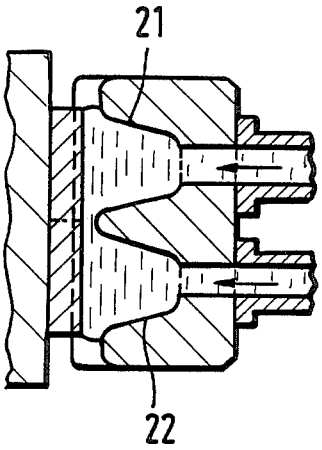
Figure 13:
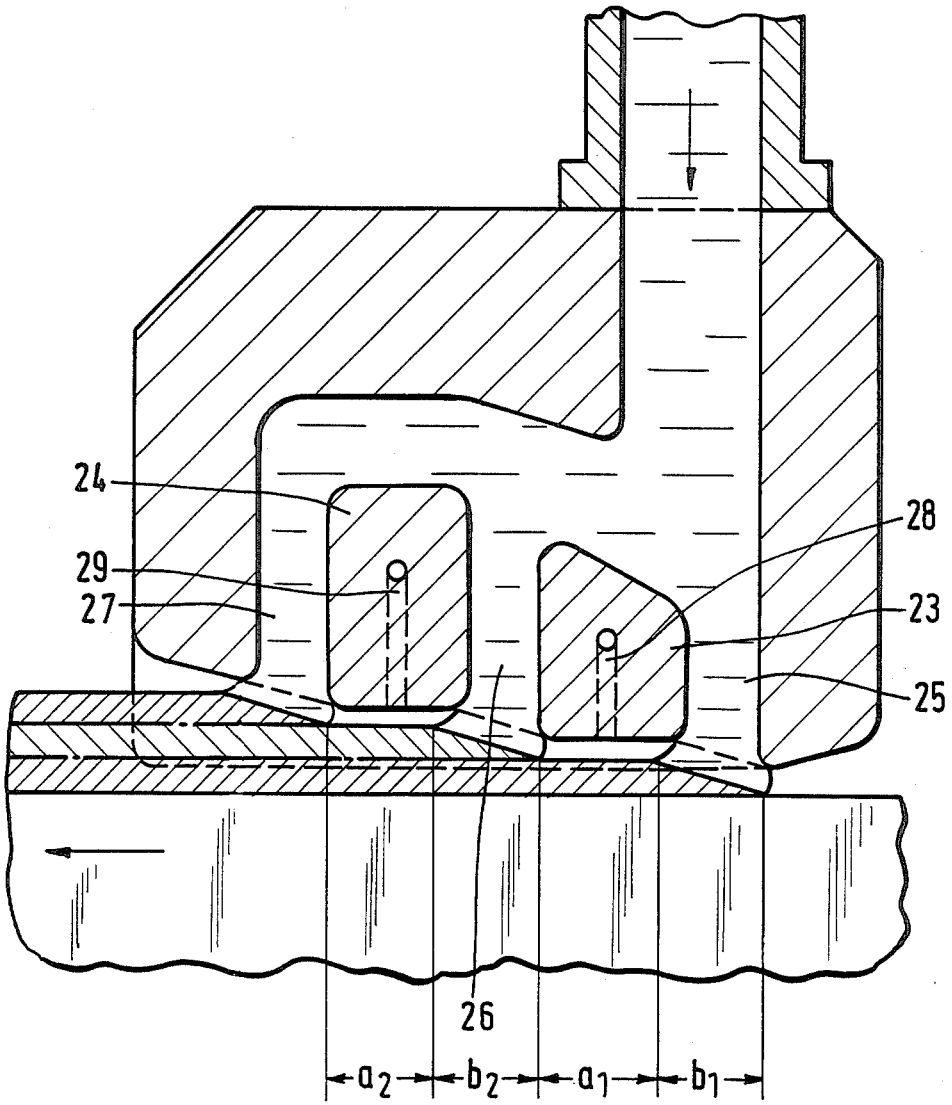
Figure 14:
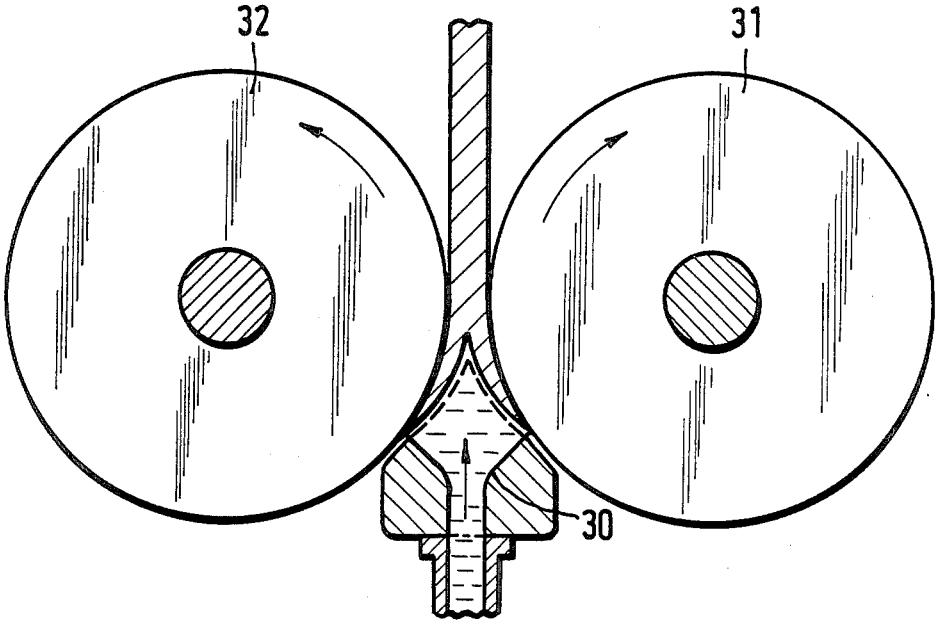
Figure 15:
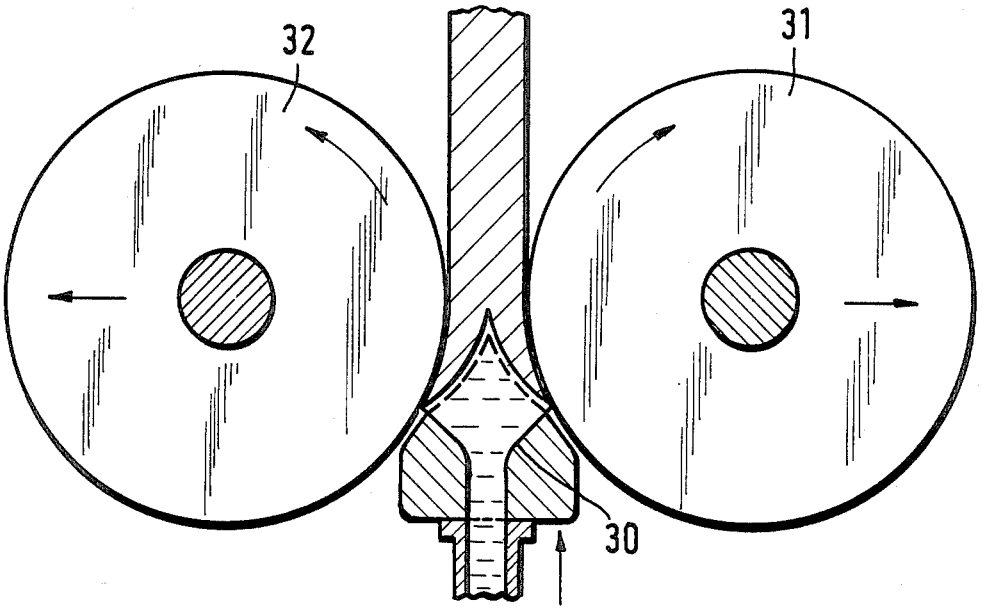
Figure 16:
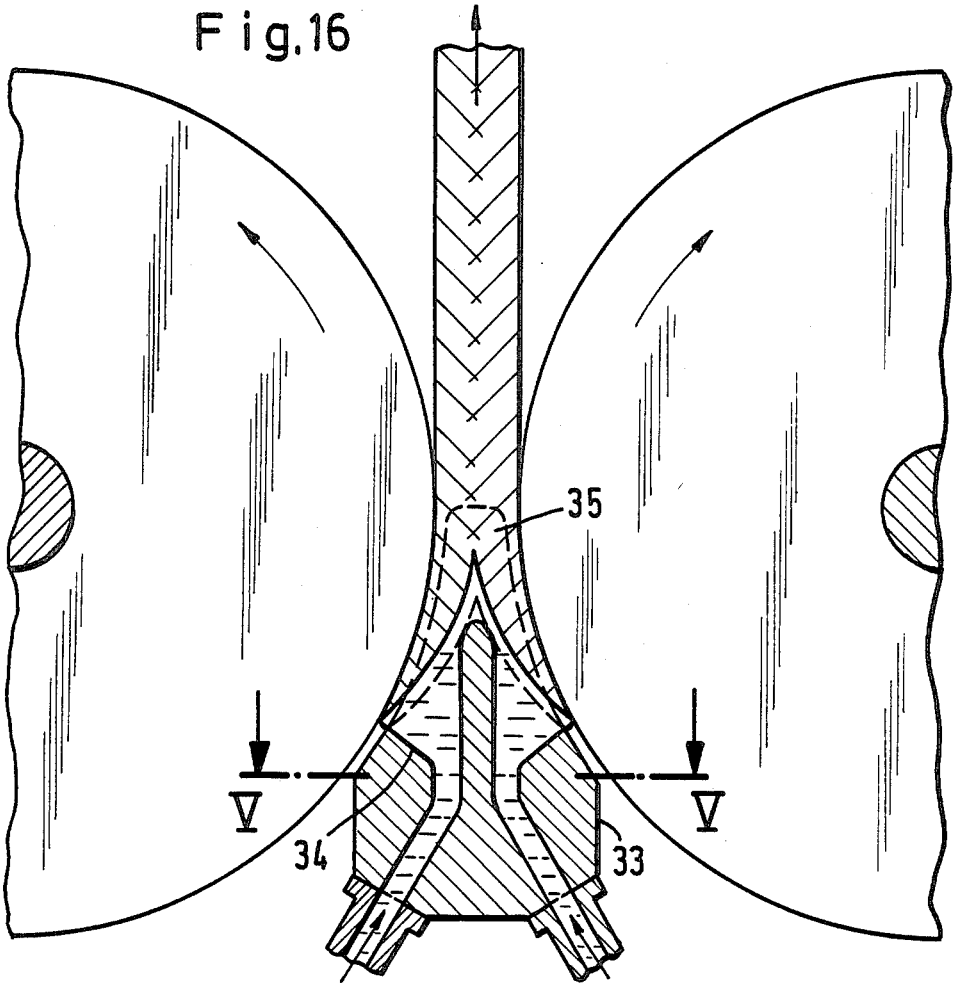
Figure 17:
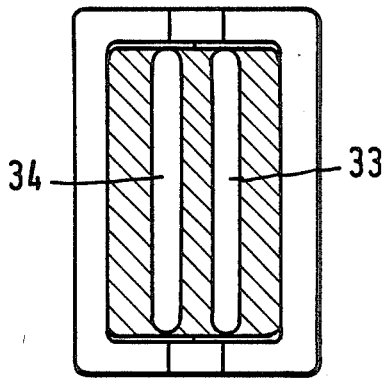
Figure 18:
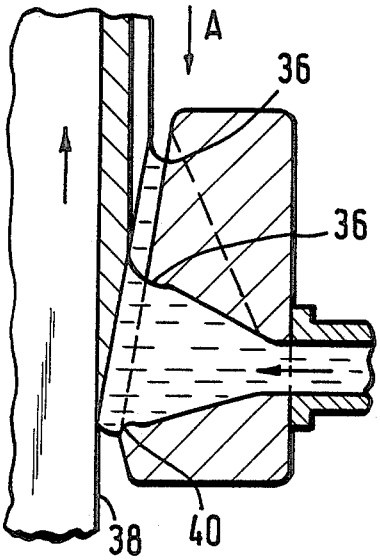
Figure 20:
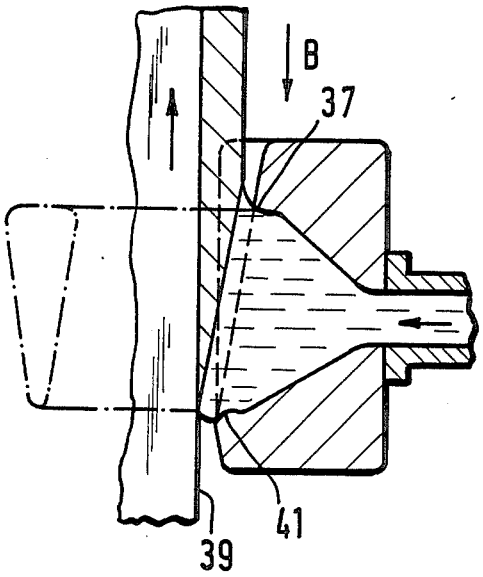
Figure 19:
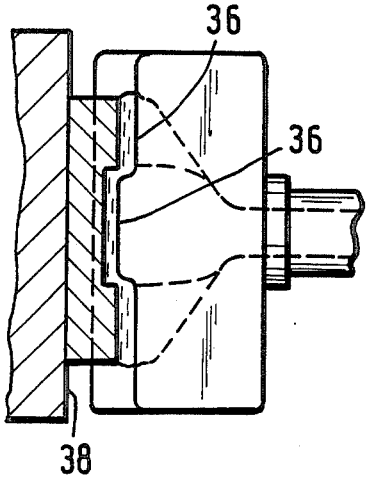
Figure 21:
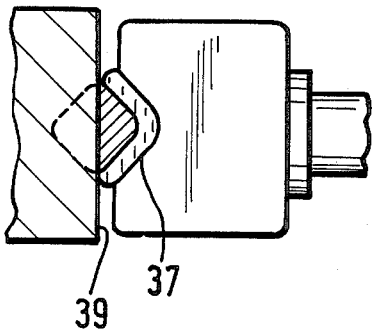
Figure 22:
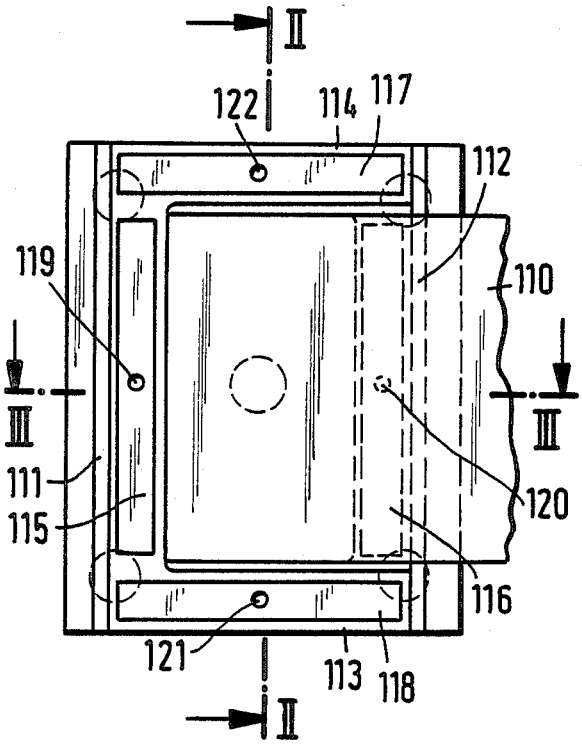
Figure 23:
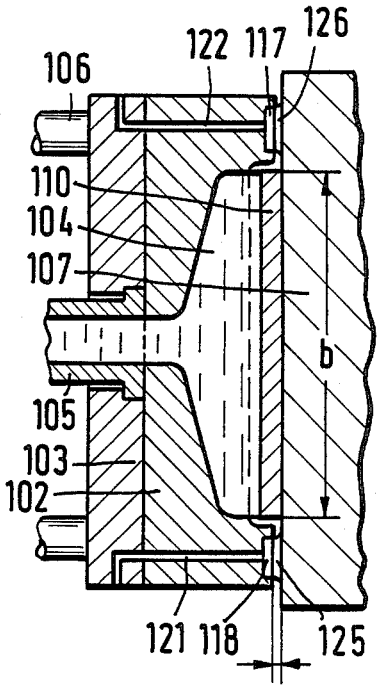
Figure 24:
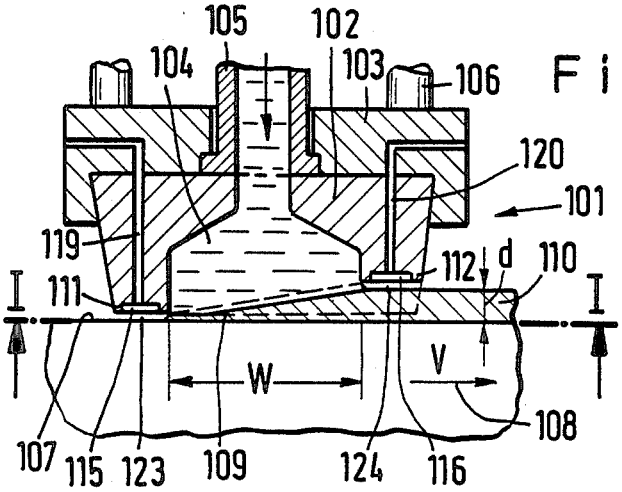
Figure 25:
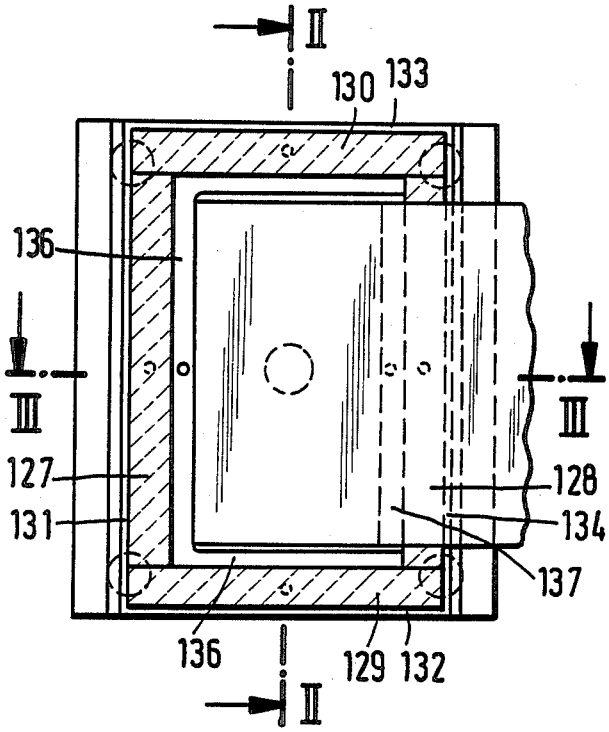
Figure 26:
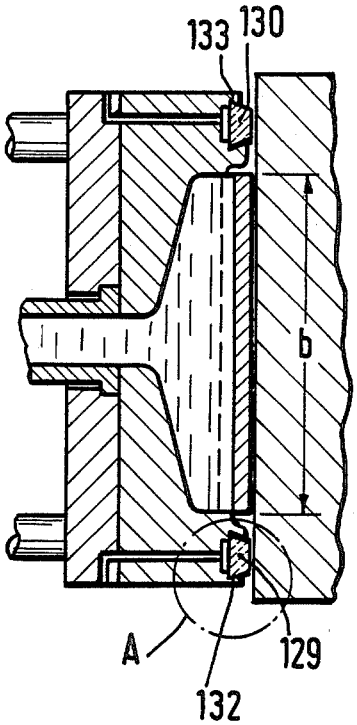
Figure 27:
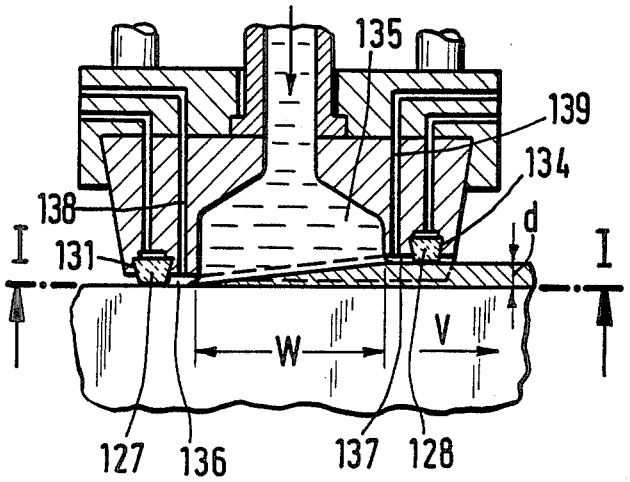
Figure 28:
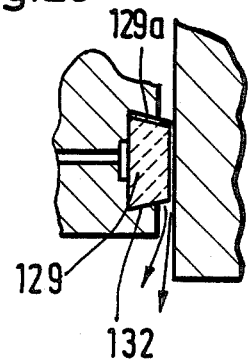
Figure 29:
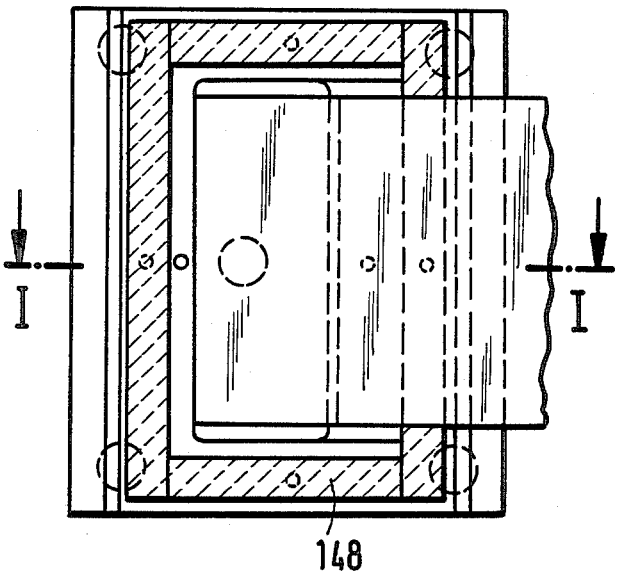
Figure 30:
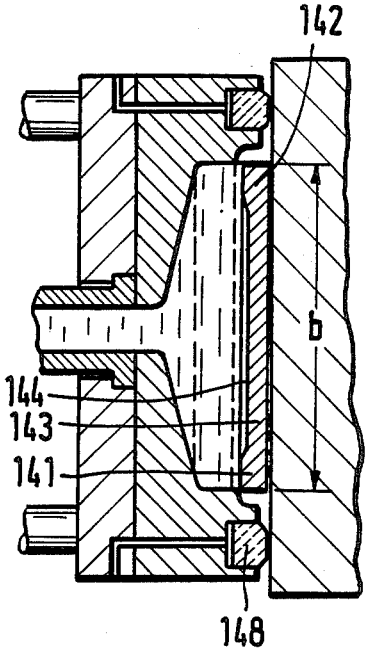
Figure 31:
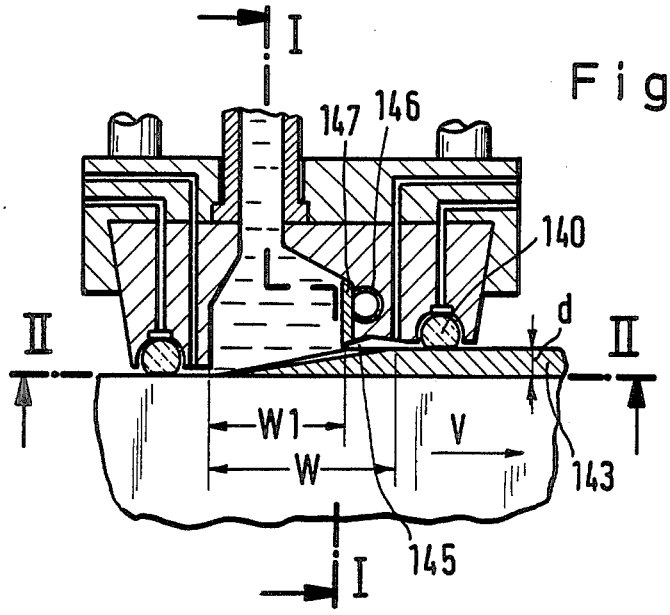
Figure 32:
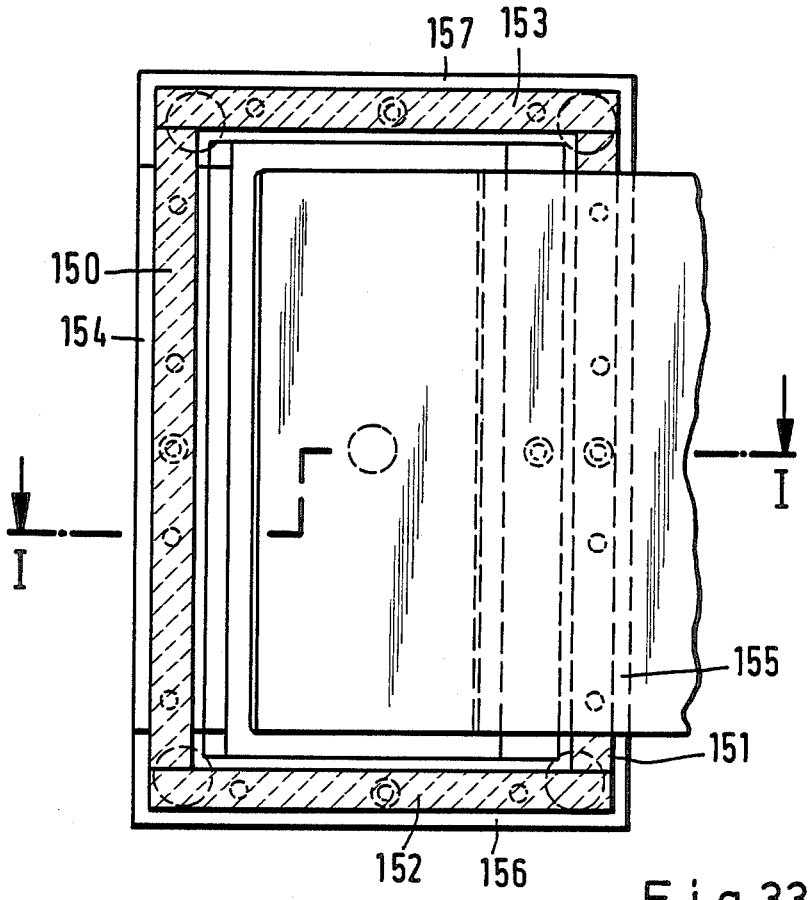
Figure 33:
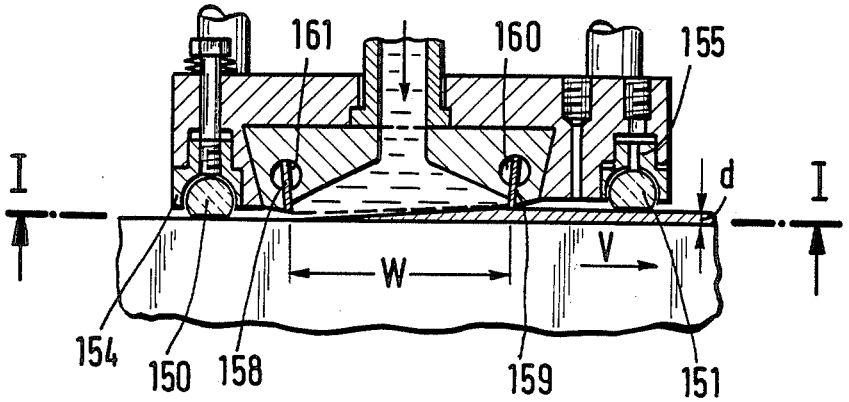

FIG. 8 the slotted die shown in FIG. 7, sectioned along the line I—I in FIG. 7,

FIG. 9 a pivotable die above a horizontally disposed movable cooling surface of a cooling member with two parallel die slots disposed one after the other in the direction of movement of the cooling surface, in cross-section in the direction of movement of the cooling surface during the start of casting, FIG. 10 the slotted nozzle shown in FIG. 9, sectioned along the line I—I in FIG. 9, FIG. 11 a pivotable slotted die above a horizontally disposed movable cooling surface of a cooling member with two nozzle slots disposed one beside the other, in cross-section in the direction of movement of the cooling surface during the start of casting, FIG. 12 the slotted die shown in FIG. 11, sectioned along the line I—I in FIG. 11, FIG. 13 a pivotable die above a horizontally disposed movable cooling surface of a cooling member with three parallel die slots disposed one after the other in the direction of movement of the cooling surface, in cross section in the direction of movement of the cooling surface, FIG. 14 a nozzle with two pivotable cooling wheels disposed in parallel one beside the other in a horizontal plane and having two cooling surfaces, in cross-section in the direction of movement of the opposite cooling surfaces during the start of casting, FIG. 15 the nozzle shown in FIG. 14, in cross-section in the direction of movement of the opposite cooling surfaces after the start of casting, FIG. 16 a nozzle with two cooling wheels disposed in parallel one beside the other in a horizontal plane and having cooling surfaces, in cross-section in the direction of movement of the opposite cooling surfaces, in a variant embodiment of FIGS. 14 and 15, FIG. 17 the nozzle shown in FIG. 16, sectioned along the line I—I in FIG. 16, FIG. 18 a non-pivotable slotted die directed laterally against a vertically disposed movable cooling surface of a cooling member and having a profiled outlet side die lip, in cross-section in the direction of movement of the cooling surface, FIG. 19 the slotted die shown in FIG. 18 in plan view, from the direction of the arrow A, FIG. 20 a non-pivotable slotted die directed laterally against a vertically disposed movable cooling surface of a cooling member and having a profiled outlet side die lip, in cross-section in the direction of movement of the cooling surface during the start of casting, in a variant embodiment of FIGS. 18 and 19, FIG. 21 the die shown in FIG. 20 in plan view, from the direction of arrow B, FIG. 22 an end elevation, taken along the line I—I in FIG. 24, of a slotted die borne via gas cushions on the movable cooling surface of a cooling member, FIG. 23 the slotted die shown in FIG. 22, sectioned along the line II—II in FIG. 22, FIG. 24 a slotted nozzle shown in FIG. 22, sectioned along the line III—III in FIG. 22, FIG. 25 an end elevation, taken along the line I—I in FIG. 27, of another slotted die borne via a gas cushions on the movable cooling surface of a cooling member, FIG. 26 a slotted nozzle shown in FIG. 25, sectioned along the line II—II in FIG. 25, FIG. 27 a slotted nozzle shown in FIG. 25, sectioned along the line III—III in FIG. 25, FIG. 28 an enlarged detail of the slotted die shown in FIG. 26, FIG. 29 an end elevation, taken along the line I—I in FIG. 31, of another slotted die borne via a gas cushion on the movable cooling surface of a cooling member, FIG. 30 a slotted nozzle shown in FIG. 29, sectioned along the line II—II in FIG. 31, FIG. 31 a slotted nozzle shown in FIG. 29, sectioned along the line I—I in FIG. 29, FIG. 32 an end elevation, taken along the line I—I in FIG. 33, of another slotted die borne via a gas cushion on the movable cooling surface of a cooling member, and FIG. 33 a slotted nozzle shown in FIG. 32, sectioned along the line I—I in FIG. 32.

In the embodiment illustrated in FIGS. 1 and 2 a slotted die 2, to which molten metal is supplied from a casting vessel (not shown) via a supply line (not shown) is disposed above a cooling member 1 constructed as a belt and moving in the horizontal direction. The pressure at which the molten metal is supplied to the slotted die 2 can be determined via the level of the molten metal in the casting vessel or by a compressed gas acting upon the molten metal. The slotted die 2 can be pivoted around a pivot 4 lying in the zone of the strip start side die lip 3 of the slotted die 2, so that the gap between the cooling surface and the strip outlet side die lip 5 can be adjusted, while maintaining the gap between the cooling surface inlet side die lip 3 and the cooling surface of the cooling member 1.

For the start of casting the slotted die 2 is so pivoted that the width of the gap in the zone of the two die lips 3, 5 is small enough to prevent molten metal from flowing out in an uncontrolled manner or accidentally. When molten metal is now cast from the slotted die 2 onto the moving cooling surface of the cooling member 1, a wedge-shaped solidification front 6 is formed. By the controlled pivoting of the slotted die 2, allowing for the speed of the moving cooling surface and therefore of the cast strip 7 also, the wedge-shaped solidification front 6 becomes progressively steeper in the zone of the slotted die 2. When pivoting the slotted die, care must be taken that the free gap between the strip outlet side die lip 5 and the solidification front does not exceed an upper limit value, since otherwise the meniscus forming here due to the viscosity of the molten metal and sealing the free gap is inadequate to hold back the molten metal.

In this way, having regard to the law of solidification, strips can be produced by casting which have practically any required width and a thickness down to the millimetre range with narrow thickness tolerances.

In the embodiment illustrated in FIGS. 3 to 6 the cooling surface of a cooling member 3 moves vertically upwards. A slotted die 9, which is also fed with molten metal from a storage tank (not shown) is so disposed in relation to the moving cooling surface of the cooling member 8 that the lower die lip 10 is at a small enough distance from the cooling surface of the cooling member to prevent any undesired outflow by using the viscosity of the molten metal. The strip outlet side die lip 11 is at a distance from the cooling surface of the cooling member 8 which corresponds to the required thickness of the strip 12 to be cast.

In comparison with the embodiment illustrated in FIGS. 3 and 4, in that shown in FIGS. 5 and 6 apron-like attachments 13, 14 are provided on the lateral die lips to give protection against splashes during the start of casting.

In the embodiments illustrated in FIGS. 3 to 6, with the cooling surface of the cooling member 8 moving upwards, the surface 15 of the bath of molten metal is raised in proportion as the wedge-shaped solidification front 16 grows. Care is taken that the gap between the lateral die lips and the wedge-shaped solidification front 16 of the strip 8 remains below an upper limit of tolerance until the strip outlet side die lip 11 is reached, thus ensuring that no molten metal flows out laterally.

While with the die in the embodiment illustrated in FIGS. 1 and 2 the casting process can be performed practically independently of position, the casting process using dies as shown in FIGS. 3 to 6 is confined to a direction of movement of the cooling surface at an inclination to the horizontal, with which the cast strip leaves the die against gravity and inclined at an upward angle of varying steepness.

After the start of casting, the speed of the moving cooling surface is so selected that even then no molten metal flows out uncontrolled. For this reason the speed is so selected that the wedge-shaped solidification front lies inside the die.

The slotted die in the embodiment illustrated in FIGS. 7 and 8 essentially differes from that shown in FIGS. 1 and 2 solely by the feature that the strip outlet side die lip 17 so bears against spring elements 18, 19 that it yields at a limit value of the pressure exerted on it by the cast strip. The die lip 17 can be designed to be adjusted by adjusting screws or adjusting wedges (not shown), so that strip thickness can be adjusted. The die in the embodiment illustrated in FIGS. 9 and 10 differs from that shown in FIGS. 1 and 2 solely by the feature that two slotted dies 19, 20 are constructed disposed one close behind the other and parallel with one another in a pivotable unit. The molten metal emerging from the two slotted dies 19, 20 is brought together in the zone of the first slotted die 19 in the molten phase at the end of the solidification front, so that the use of such a die enables two-layer strip material to be produced which is intimately interconnected at the boundary zone of the two layers.

The embodiment illustrated in FIGS. 11 and 12 differs from that shown in FIGS. 1 and 2 by the feature that two slotted dies 21, 22 are disposed close beside one another and constructed in the form of a pivotable unit. The molten metal is brought together in the zone of the common central die lip in the molten phase. This embodiment enables a strip to be produced consisting of two ribbons disposed one beside the other and intimately interconnected at their adjacent edges.

The embodiment illustrated in FIG. 13 differs from that shown in FIGS. 1 and 2 by the feature that the die slot is subdivided into three individual slots 25, 26, 27 by two webs 23, 24 extending transversely of the direction of movement of the cooling surface. While a wedge-shaped solidification front forms in the zone of the component slots 25, 26, 27, in the zones of the webs 23, 24 a further cooling takes place of the layers already completely solidified at that place. Protective gas acts via ducts 28, 29 on the layers in the zone of the webs 23, 24. The length of the cooling distances a1, a2 should be 0.8 to 16 times the width b1, b2 of each preceding die slot 25, 26. With a multiple die constructed in this way, thick, amorphously solidified metal strips can be built up from individual, relatively thin layers.

The special feature of the embodiment illustrated in FIGS. 15 and 16 is that a casting gap, into which molten metal is introduced from below from a die 30, is formed by two cooling wheels 31, 32, which are disposed in parallel one beside the other in a horizontal plane and rotate in the same sense in the zone of the casting gap. The distance between the cooling wheels 31, 32 and therefore the inside width of the casting gap can be adjusted.

This embodiment operates like two slotted dies disposed directly one beside the other, the two solidification fronts of the two layers of the strip cast on the cooling wheels 31, 32 taking over the function of an actual strip outlet side die lip, which is dispensed with. To prevent the molten metal from flowing out at the side during the start of casting, allowing for the solidification fronts building up in dependence on the speed of the cooling surfaces of the cooling wheels 31, 32, the width of the casting gap is increased from a small initial value to the final value corresponding to the required strip thickness, so that molten metal does not flow out undesirably. This embodiment is based on the principle of the embodiment illustrated in FIGS. 1 and 2.

The embodiment illustrated in FIGS. 16 and 17 differs from that shown in FIGS. 14 and 15 by the feature that the casting gap is fed not from one die, but from two dies 33, 34. With this embodiment two-layer strips can be produced from different metals—i.e., bimetallic strips. As in the embodiment illustrated in FIGS. 9 and 10, in this case also the metals of the two layers are brought together in the molten phase. As in the embodiment illustrated in FIGS. 5 and 6, an apron-like protection 35 against splashes can be provided at the sides. Of course, such a protection against splashes can also be provided in the embodiment illustrated in FIGS. 14 and 15.

In the embodiments illustrated in FIGS. 18 to 21 the strip outlet side die lip 36, 37 is profiled—i.e., has a different distance from the cooling surface over the width of the die. So that a solidification front allowing for this profile can form which prevents the molten metal from flowing out uncontrolled, the particular die width, viewed in the direction of movement of the cooling surface, is shaped in dependence on the particular strip thickness—i.e., with a small strip thickness and therefore also a short distance between the die lip and the cooling surface the lip width is small, while with a large strip thickness and therefore also a long distance between the die lip and the cooling surface the die width is large. The profile of the die lip is shown in plan view on the left in FIG. 20.

Very differently profiled strips and strands can be cast by this principle, which always ensures that molten metal cannot emerge undesirably and that the profiles are to very accurate dimensions.

With the embodiments illustrated in FIGS. 22 and 33, even narrower tolerances and smoother strip surfaces can be obtained during casting.

Referring to FIGS. 22 to 24, a slotted die 101 has a die body 102 disposed in a holder 103. A die chamber 104 of the slotted die 101 is connected via a line 105 to a vessel (not shown) for molten metal. The molten metal can be introduced by pressure into the chamber 104. By means of adjusting members 106 the inclination of the slotted die 101 and the distance of its end face can be adjusted in relation to cooling surface 107 of a cooling member (not shown) adjustable in the direction indicated by arrow 108.

As can be seen from FIG. 24, with a cooling surface 107 advanced at a speed v in the direction of the arrow 108, on the cooling surface 107 in the zone of the die chamber 104 a solidification wedge 109 is formed which reaches the thickness d of the completed strip 110 at the strip outlet side edge of the chamber 104. Solidification is therefore completed in the zone of the die chamber 104.

In the end faces of the cooling surface inlet side, strip outlet side and lateral die lips 111 to 114 a shallow chamber 115 to 118 is provided, to each of which gas can be supplied via a line 119 to 122 for building up an end face gas cushion 123, 124, 125, 126, via which the slotted die bears against the cooling surface 107 and the top side of the completed strip 110. The distance of the die lips 111 to 114 from the cooling surface 107 and the strip 110 can be adjusted via the gas pressure in the individual gas cushions 123 to 126.

The embodiment illustrated in FIGS. 25 to 28 differs from that shown in FIGS. 22 to 24 in two features. Pressurized gas is supplied and distributed via batten-like porous bodies 127 to 130, whose sides adjacent die chamber 135 bear a gas-tight coating 129*a*, so that the gas supplied can build up in front of the porous end face of each porous member 128 to 130 and flow away, as indicated in FIG. 28. The porous bodies 127, 129, 130 are fixed in wedge-shaped grooves 131 to 133, while the strip outlet side porous body 128 is retained in a groove 134 with parallel walls adjustably in the direction of the cooling surface 107. In this way the air cushion with the porous body 128 can adapt itself to fluctuating thickness of the strip and ensure support. The second different feature of the embodiment illustrated in FIGS. 22 to 24 is that disposed between the air cushions containing the porous bodies 127 to 130 and the die chamber 135 are chambers 136, 137, into which either heated protective gas can be introduced via lines 138, 139 or via which gas emerging from the air cushions can be removed. The purpose of both alternatives is to prevent the strip surface from oxidizing. Another objective is to prevent, more particularly by the supply of protective gas or the removal of gas from the air cushion via the cooling surface inlet side chamber 136, beads of condensate and gas from developing between the cooling surface 107 and the adjacent side of the strip to such an extent as to spoil the smoothness of the strip surface.

Since as a rule the cooling surface 107 is wider than the cast strip 110, heat is better removed from the strip edges than from its centre. For this reason the wedge-shaped solidification front in the zone of the die chamber is steeper at the strip edges than in the central zone of the strip. The embodiment illustrated in FIGS. 29 to 31 takes this fact into account. While in zone W1 solidification is completed at the strip edges, it extends in the centre of the strip over the zone W. The larger distance of the strip outlet side air cushion, containing a porous body 140, in comparison with the other embodiments enables molten metal between the solidified edge zones 141, 142 of the strip 143 to pass the outlet side edge 145 of the die chamber 146 and solidify in the portion between such edge 145 and the porous body 140. Due to the pressure built up in this zone, molten metal cannot emerge uncontrollably from the larger gap in the central zone.

The embodiment illustrated in FIGS. 21 to 31 differs from the preceding embodiments by the feature that the strip outlet side edge 145 is formed by an interchangeable batten 147 heated by a heating device 146. The heated batten prevents the metal from freezing on the top side of the strip as early as the zone of the edge 145, and therefore ensures a smooth strip surface. This embodiment also differs from the preceding ones by the feature that the porous members 140 at the inlet side die lip and the outlet side die lip have at least a partially round cross-section and a flat end face and can be rotated around their axes in the matching grooves. As a result the flat end faces of the porous members 140 adjust themselves parallel with the cooling surface and strip surface at every angle of inclination of the end face of the die. A further difference is that the lateral porous bodies 148 are mounted for vertical adjustment in grooves 149, so that they can automatically adjust themselves in dependence on the angle of inclination of the end face of the die.

In the embodiment illustrated in FIGS. 32 and 33 the porous bodies 150 to 153, having partly a circular cross-section and a flat end face, are disposed in adjustable holders 154 to 157, so that the position of the slotted die can be adjusted in relation to the cooling surface, while the holders 154 to 157 with the porous bodies 150 to 153 can be adjusted independently thereof. In addition, interchangeable die lips 158, 159 are inserted in the die body and can be heated via ducts 160, 161.

The gas-permeable porous bodies 127 to 130, 140, 150 to 153 preferably consist of sintered material, ceramic fibre, carbon graphite or a similar material having as far as possible certain emergency running properties in relation to the material of the cooling surface.

Highly heat-resistant metal, such as tungsten, molybdenum or a corresponding alloy, or a ceramic material resistant to wear and thermal shock and as far as possible melt-repelling, such as $Al_2O_3$, SiC, $Si_3N_4$, $ZrO_2$, NgO or the like is a suitable material for the insertable, heatable die lips 145, 158, 159. However, instead of die lips being inserted, such materials can be sintered onto or used as reinforcement on the die body or the end face. Preferably the die lips are heated.

We claim:

1. In a process for the production of metal strands, including providing a moving cooling surface of a cooling member and applying molten metal from a first slotted die onto the cooling surface as it moves past the die with a narrow gap therebetween, the improvement comprising: starting the step of applying by forming a wedge-shaped solidification front within the region of the die by adjusting at least one of the speed of the cooling surface and the width of the gap to prevent uncontrolled flow of the molten metal comprising disposing the die at an initial gap width which is narrower than that of said narrow gap and thereafter gradually increasing the gap width while keeping the solidification front within the region of the die.

2. A process according to claim 1, wherein the speed of the cooling surface of the cooling member is so adjusted that the solidification front remains inside the die after the step of starting.

3. A process according to claim 1, wherein molten metal is applied to the surface of the metal strand remote from the cooling surface by disposing another die immediately upstream of the first die, and applying the molten metal in the same manner as from the first die.

4. A process according to claim 3, wherein the molten metal from the other die is applied to the metal strand from the first die while the surface is still molten.

5. A process according to claims 3, wherein the surface remote from the cooling surface is protected against oxidizing influences until the molten metal is applied thereto.

6. A process according to claim 1, further comprising applying molten metal from at least one second die to the moving cooling surface immediately alongside the molten metal from the first die, in the same manner and bringing the metals emerging from the two dies together in their molten phase in the area of their boundary zones.

7. A process according to claim 3, wherein various metals are brought together.

8. A process according to claim 3, wherein a number of layers are cast one above the other with the strip passing through a cooling distance before the next layer is applied.

9. A process according to claim 8, wherein in the zone of each cooling distance, the surface of the particular layer remote from the cooling surface is one of kept under a protective gas atmospher and in a zone which is at least partially evacuated.

10. A process according to claim 8 wherein the length of the cooling distance is 0.8 to 16 times the width of the preceding die in the direction of movement of the cooling surface of the cooling member.

11. In a process for the production of metal strands, including providing a moving cooling surface of a cooling member and applying molten metal from a first slotted die onto the cooling surface as it moves past the die with a narrow gap therebetween, the improvement comprising: starting the step of applying by forming a wedge-shaped solidification front within the region of the die by adjusting at least one of the speed of the cooling surface and the width of the gap to prevent uncontrolled flow of the molten metal, wherein the cooling surface moves upwardly, forming a wedge-shaped gap between the die and the cooling surface and wherein the step of adjusting comprises initially setting the speed of the moving cooling surface to maintain the level of the molten metal at an initial low level and adjusting the speed to gradually increase the level to a higher normal operating level.

12. A process according to claim 11, wherein the level of the molten metal is so raised that the gap between the lateral die edges and the solidification front is sufficient to prevent the molten metal from flowing out uncontrolled.

13. A process according to claim 11, wherein the speed of the cooling surface of the cooling member is so adjusted that the solidification front remains inside the die after the step of starting.

14. A process according to claim 11, wherein molten metal is applied to the surface of the metal strand remote from the cooling surface by disposing another die immediately upstream of the first die, and applying the molten metal in the same manner as from the first die.

15. A process according to claim 14, wherein the molten metal from the other die is applied to the metal strand from the first die while the surface is still molten.

16. A process according to claim 14, wherein the surface remote from the cooling surface is protected against oxidizing influences until the molten metal is applied thereto.

17. A process according to claim 11, further comprising applying molten metal from at least one second die to the moving cooling surface immediately alongside the molten metal from the first die, in the same manner and bringing the metals emerging from the two dies together in their molten phase in the area of their boundary zones.

18. A process according to claim 14, wherein various metals are brought together.

19. A process according to claim 14, wherein a number of layers are cast one above the other with the strip passing through a cooling distance before the next layer is applied.

20. A process according to claim 19, wherein in the zone of each cooling distance, the surface of the particular layer remote from the cooling surface is one of kept under a protective gas atmosphere and in a zone which is at least partially evacuated.

21. A process according to claim 1, wherein the length of the cooling distance is 0.8 to 16 times the width of the preceding die in the direction of movement of the cooling surface of the cooling member.

* * * * *

UNITED STATES PATENT AND TRADEMARK OFFICE

CERTIFICATE OF CORRECTION

PATENT NO. : 4,719,963

DATED : January 19, 1988

INVENTOR(S) : Horst Schenk, et al.

It is certified that error appears in the above-identified patent and that said Letters Patent is hereby corrected as shown below:

| | |
|---|---|
| Col. 3, line 13 | Delete "brough" and substitute --brought-- |
| Col. 13, line 15 | Correct spelling of --atomosphere-- |
| Col. 14, line 37 | Delete "claim 1" and substitute --claim 19-- |

Signed and Sealed this

Twentieth Day of September, 1988

*Attest:*

*Attesting Officer*

DONALD J. QUIGG

*Commissioner of Patents and Trademarks*